US006050091A

United States Patent [19]

Maruta

[11] Patent Number: 6,050,091

[45] Date of Patent: Apr. 18, 2000

[54] BRAKE DEVICE FOR OIL HYDRAULIC MOTOR

[75] Inventor: Kazuhiro Maruta, Tochigi-ken, Japan

[73] Assignee: Komatsu Ltd., Tokyo, Japan

[21] Appl. No.: 09/125,219

[22] PCT Filed: Mar. 27, 1997

[86] PCT No.: PCT/JP97/01057

§ 371 Date: Aug. 13, 1998

§ 102(e) Date: Aug. 13, 1998

[87] PCT Pub. No.: WO97/36062

PCT Pub. Date: Oct. 2, 1997

[30] Foreign Application Priority Data

| | | | |
|---|---|---|---|
| Mar. 27, 1996 | [JP] | Japan | 8-071956 |
| Mar. 27, 1996 | [JP] | Japan | 8-072000 |

[51] Int. Cl.[7] ..... F16D 31/02

[52] U.S. Cl. ..... 60/436; 60/422

[58] Field of Search ..... 60/435, 436, 442

[56] References Cited

U.S. PATENT DOCUMENTS

| | | | |
|---|---|---|---|
| 4,317,331 | 3/1982 | Aruga et al. | 60/436 |
| 4,464,898 | 8/1984 | Aoyagi et al. | 60/436 |
| 4,495,767 | 1/1985 | Akiyama et al. | 60/436 |
| 4,543,786 | 10/1985 | Shuler | 60/436 X |
| 4,615,174 | 10/1986 | Nagahara | 60/442 |
| 4,694,647 | 9/1987 | yoshida | 60/442 X |
| 4,729,222 | 3/1988 | Tanaka et al. | 60/436 |
| 4,858,435 | 8/1989 | Ikeda | 60/442 X |
| 5,531,071 | 7/1996 | Asano | 60/441 |
| 5,709,083 | 1/1998 | Sorbel et al. | 60/436 X |

FOREIGN PATENT DOCUMENTS

| | | | |
|---|---|---|---|
| 55-82801 | 6/1980 | Japan | 60/435 |
| 55-139505 | 10/1980 | Japan | 60/436 |
| 57-110857 | 7/1982 | Japan | 60/436 |
| 57-110858 | 7/1982 | Japan | 60/436 |
| 57-110860 | 7/1982 | Japan | 60/436 |
| 59-1864 | 1/1984 | Japan | 60/435 |
| 61-97060 | 6/1986 | Japan . | |
| 62-100306 | 6/1987 | Japan . | |
| 6-321089 | 11/1994 | Japan . | |
| 8-4803 | 1/1996 | Japan . | |
| 878728 | 11/1981 | Russian Federation | 60/436 |
| 945503 | 7/1982 | Russian Federation | 60/436 |
| 1681088 | 9/1991 | Russian Federation | 60/436 |

*Primary Examiner*—John E. Ryznic

*Attorney, Agent, or Firm*—Frishauf, Holtz, Goodman, Langer & Chick, P.C.

[57] ABSTRACT

A braking apparatus for a hydraulic motor (20) having a rotary component (21) includes a rotary side friction plate (22) coupled to the rotary component of the hydraulic motor, a fixed side friction plate (23) coupled to a fixed component of the hydraulic motor, and a braking cylinder assembly (24) having a piston (25), a spring (26) and a piston pressure receiving chamber (27). The piston is energizable by the spring to move in a braking direction for bringing the fixed side and the rotary side friction plates into a pressure contact, whereas the piston pressure receiving chamber can be be supplied with pressure fluid to displace the piston in a braking release direction, thereby separating the fixed side friction plate and the rotary side friction plate from each other. An operating valve (41, 42) supplies pressure fluid into the hydraulic motor, and a hydraulic pilot valve (52, 53) provides pilot pressure fluid for use to switch the operating valve. A pilot pressure fluid from the hydraulic pilot valve is delivered through a hydraulic circuit (28) into the piston pressure receiving chamber. The braking apparatus further includes in the hydraulic circuit a fluid flow control valve (30) which has an area of valve opening progressively reduced as a function of a distance of travel of the piston moving and displaced from a braking position towards a braking release position.

13 Claims, 10 Drawing Sheets

BRAKE DEVICE FOR OIL HYDRAULIC MOTOR

TECHNICAL FIELD

The present invention relates to a braking apparatus for a hydraulic motor, e.g., a hydraulic motor that is adapted for use in turning an upper vehicle body in a power shovel.

BACKGROUND ART

In the art there has hitherto been known a hydraulic motor in which a cylinder block is mounted in a housing so as to be axially rotatable. The cylinder block contains a cylinder bore in which a piston is slidably inserted providing a cylinder chamber such that with a leading end portion of the piston slidably driven along a swash plate an axial sliding movement of the piston may be effected. Fluid communication of the cylinder chamber alternate with a hydraulic supply and a reservoir allows the cylinder block to be axially rotated.

A known braking apparatus for a hydraulic motor of the type described is illustrated in FIG. 1. As illustrated, a cylinder block 1 and a housing 2 have rotatable side friction plates 3 and fixed side friction plates 4 attached respectively thereto and arranged together so that a former plate and a latter plate may be placed alternately. A piston 5, which is juxtaposed with a friction plate arrangement of these plates 3 and 4, is pushed by a spring 6 to bring the fixed side and rotation side friction plates 4 and 3 into a mutual pressure contact, thereby applying a braking to a movement of the cylinder block 1. Supplying a fluid under an elevated pressure into a pressure receiving chamber 7 for the piston 5 causes the piston 5 to be displaced against a resilient pressure by the spring 6 to separate the fixed side friction plates 4 and the rotation side friction plates 3 away from one another, thereby releasing the braking force applied to the cylinder block 1.

A further detail of the braking apparatus shown and described is schematically illustrated in FIG. 2 for a hydraulic motor 10. Disposed as juxtaposed with a rotating part 11 of the hydraulic motor 10 is a braking cylinder assembly 12 having a piston 13. The piston 13 is adapted to be displaced in a braking direction (here in the direction in which it is extended) as energized by a spring 14 and to be displaced in the opposite direction (here in the direction in which it is retracted) to release the braking when a piston pressure receiving cylinder chamber 15 is supplied with a pressure fluid.

A pressure fluid for supplying into the piston pressure receiving chamber 15 in the braking cylinder assembly 12 (a braking release pressure fluid) may well be an output pressure fluid delivered from a hydraulic pilot valve which is designed for a hydraulic motor, i.e. a valve to provide a pilot pressure fluid for switching an operating valve used to hydraulically drive the motor.

Typically, a hydraulic power shovel comprises a plurality of hydraulic actuators including a boom cylinder, an arm cylinder and a bucket cylinder, a plurality of operating hydraulic valves used to supply pressure fluid to these actuators, including a boom operating hydraulic valve, an arm operating hydraulic valve and a bucket operating hydraulic valve and a plurality of pilot valves for supplying pilot switching pressure fluid to these operating valves, including a boom associated pilot valve, an arm associated pilot valve and a bucket associated pilot valve. Each of these pilot valves and a hydraulic motor associated pilot valve mentioned in the preceding paragraph are coupled to and located at the discharge outlet of a single hydraulic pump.

The piston pressure receiving chamber 15 in the braking cylinder assembly 12 has a large pressure receiving area and also provides a long piston stroke in the braking release direction. Hence, displacing the piston 13 to the extent of its stroke end in order to release braking with the braking apparatus requires a plenty of pressure fluid to be supplied into the piston pressure receiving chamber 15 in the braking cylinder assembly 12.

In a compound operation in which the hydraulic motor and the arm are simultaneously operated to perform a turning operation and an arm control operation at the same time, supply of a plenty of pressure fluid from the hydraulic motor associated pilot valve into the piston pressure receiving chamber 15 in the braking cylinder assembly 12 extremely reduces the pressure of pilot pressure fluid, however. A delay may then be caused in the switching of the arm operating hydraulic valve by a failure of the piston 13 of the braking cylinder assembly 12 to be moved to the extent of its stroke end, deteriorating the operating performance of any of the other component associated hydraulic actuators in such a compound operation.

In the braking apparatus described, a means such as a switching valve may also be used to supply pressure fluid into the piston pressure receiving chamber 15 in the braking cylinder 12, or to allow pressure fluid to flow out of the piston pressure receiving chamber into a reservoir. It has then be experienced, however, that air tends to be entrapped in a circuit connecting the switching valve to the piston pressure receiving chamber of the braking cylinder assembly, a fluid passage in the switching valve and a circuit connecting the switching valve to the reservoir, assembled or while being assembled, and such air entrapment could seldom be expelled or extracted. The entrapment of air that remains lengthens the time which is elapsed actually for a breaking, i.e. the time from an instant at which the braking apparatus is acted on to commence releasing a breaking up to an instant when the fluid pressure in the piston pressure receiving chamber has been built up to a pre-established level to complete the braking release action.

It is accordingly an object of the present invention to provide a braking apparatus for a hydraulic motor, that can resolve the problem mentioned above.

SUMMARY OF THE INVENTION

In order to achieve the above mentioned object, there is provided in accordance with the present invention in a first form of embodiment thereof a braking apparatus for a hydraulic motor, which comprises:

- a rotary side friction plate coupled to a rotary component of the hydraulic motor;
- a fixed side friction plate coupled to a fixed component of the hydraulic motor;
- a braking cylinder assembly having a piston, a piston pressure receiving chamber and a spring, wherein the said piston is adapted to be energized by the said spring to move in a braking direction for bringing the said fixed side friction plate and the said rotary side friction plate into a pressure contact, and the said piston pressure receiving chamber is adapted to be supplied with pressure fluid to displace the said piston in a braking release direction for separate the said fixed side friction plate and the said rotary side friction plate from each other;
- an operating valve for supplying pressure fluid into the said hydraulic motor;
- a hydraulic pilot valve for providing pilot pressure fluid for use to switch the said operating valve;

a hydraulic circuit for delivering pilot pressure fluid from the said hydraulic pilot valve into the said piston pressure receiving chamber; and a fluid flow control means in the said hydraulic circuit and having an area of opening progressively reduced as a function of a distance of travel of the said piston moving and displaced from a braking position towards a braking release position.

According to the construction mentioned above, it can be seen and should be understood that pilot pressure fluid from a hydraulic pilot valve for use to switch an operating valve, e.g., a valve for providing a turning action, may effectively be used to displace the piston in the braking cylinder assembly in a breaking release direction, thereby releasing a braking action applied by the braking apparatus.

Accordingly, since just an operation such as to rotate a hydraulic motor for proving the turning action allows a braking apparatus to be automatically released, not only will the entire hydraulic system be freed from malfunctioning, but it makes it unnecessary to operate a braking apparatus separately, thus simplifying operations thereof.

In the braking apparatus according to the present invention, it should also be noted that the flow of pressure fluid supplied into the piston pressure receiving chamber in the braking cylinder assembly is great in an initial period of the operation in which the piston is displaced from the breaking position towards a breaking release position, is reduced progressively thereafter as a function of the distance of travel of the piston and is small when the piston is displaced until it reaches its stroke end, thus providing an accelerated breaking release operation by the time at which the fixed side friction plate is separated from the rotation side friction plate. Any significant pressure drop of the pilot fluid from the hydraulic pilot valve is also avoided.

It follows, therefore, that in a compound operation in which a hydraulic motor and other hydraulic actuators are simultaneously driven with a plurality of operating valves switched by pilot pressure fluid from a plurality of pilot valves, there should be no substantial pressure drop in pressure fluid delivered from any of these pilot valves, permitting their respective associated operating valves to be switched smoothly, giving rise to no deterioration in operating performance of the other hydraulic actuators.

In the construction described above, the said flow control means may include:

a fluid control bore disposed in a housing of the said hydraulic motor and being in fluid communication with the said piston pressure receiving chamber;

a fluid inlet bore being in communication with the said fluid control bore through an area of fluid communication and adapted to accept the pilot pressure fluid from the said hydraulic pilot valve;

a spool slidably fitted in the said fluid control bore;

a spring chamber defined at one end side of the said spool;

a spring accommodated in the said spring chamber for urging the said spool in contact with the said piston; and an axial bore formed in the said spool for normally maintaining the said piston pressure receiving chamber and the said fluid inlet bore in communication with the said spring chamber, wherein the said spool is shaped so as to allow the area of fluid communication between the said fluid inlet bore and the said piston pressure receiving chamber to be progressively reduced as a function of a distance of travel of the said spool displaced towards the said piston.

According to the construction mentioned above, it can be seen and should be understood that providing the flow control means in a housing of the hydraulic motor makes the flow control means not to dispose separately in a portion of a pipe arrangement for coupling an output circuit of any of the hydraulic pilot valves and the piston pressure receiving chamber in the braking cylinder assembly and thus simplifies the pipe arrangement.

The present invention also provides in a second form of embodiment thereof, a braking apparatus for a hydraulic motor, which comprises:

a rotary side friction plate coupled to a rotary component of the hydraulic motor;

a fixed side friction plate coupled to a fixed component of the hydraulic motor;

a braking cylinder assembly having a piston, a piston pressure receiving chamber and a spring, wherein the said piston is adapted to be energized by the said spring to move in a braking direction for bringing the said fixed side friction plate and the said rotary side friction plate into a pressure contact, and the said piston pressure receiving chamber is adapted to be supplied with pressure fluid to displace the said piston in a braking release direction for separating the said fixed side friction plate and the said rotary side friction plate from each other;

a pressure fluid supply means for supplying and terminating a supply of, pressure fluid into the said piston pressure receiving chamber;

a hydraulic circuit for delivering pressure fluid from the said pressure fluid supply means to the said piston pressure receiving chamber; and a drain circuit for establishing a fluid communication of the said piston chamber with an internal drain path of said hydraulic motor.

According to the construction mentioned above, it can be seen and should be understood that the pressure fluid supply means supplying pressure fluid into the piston pressure receiving chamber allows air introduced into the hydraulic circuit that couples together the pressure fluid supply means and the piston pressure receiving chamber to be led out through the said drain circuit into an internal drain path of the hydraulic motor, and hence provide a complete removal of air that may have been entrained into the braking apparatus, e.g., while it is assembled.

This permits the pressure in the piston pressure receiving chamber of the braking apparatus to be elevated to a predetermined level in a short period of time to displace the piston quickly in the breaking release direction until it reaches its stroke end, and hence provides a reduction in the time period expended from the time instant of starting a braking release operation up to the time instant at which the braking release has been accomplished.

Also, since the pressure fluid in the piston pressure receiving chamber is allowed to flow from the drain circuit into the internal drain path of the hydraulic motor when the piston in the braking chamber is displaced in the braking release direction, there could be no material pressure then left in the piston pressure receiving chamber or in a hydraulic circuit mentioned as above, eventually permitting the fixed side friction plate to establish a pressure contact with the rotation side friction plate under the spring force of a spring.

This effectively provides producing a braking torque that is commensurate with the spring force of the spring.

In the construction described above, it should be noted that the said pressure fluid supply means may be constituted by a separate source of pressure.

Also, in the construction described above, the said pressure fluid supply means may be constituted by a hydraulic pilot valve for providing pilot pressure fluid for use to switch an operating valve that is dedicated for supplying pressure fluid into the hydraulic motor.

According to the construction mentioned above, it can be seen and should be understood that rotation of the hydraulic motor with the operating valve therefor switched with pilot pressure fluid furnished from the corresponding pilot valve causes displacement of the piston in the braking release direction and establishes a braking release state for the braking apparatus.

Thus, releasing the braking apparatus from a braking state following the hydraulic motor, e.g., driven to rotate makes its braking operation simplified.

The braking apparatus can also be released from its braking state when the hydraulic motor ceases driving with its associated operating valve switched into its neutral position by bringing the pilot valve dedicated thereto into its neutral position to cause the pressure fluid in the piston pressure receiving chamber of the braking cylinder assembly to flow out into an internal drain path of the hydraulic motor.

In the construction mentioned above, the said pressure fluid supply means may be constituted by a hydraulic pilot valve for providing pilot pressure fluid for use to switch an operating valve that is dedicated for supplying pressure fluid into the hydraulic motor.

According to the construction described above, it can be seen and should be understood that the development of a load pressure in the hydraulic motor that is driven into a rotation or the development of a load pressure in any of the actuators that is operated to be driven in a working machine displaces the piston of the braking cylinder assembly in the braking release direction under such a load pressure and thus establishes a braking release state for the braking apparatus.

This allows an operation to rotate the hydraulic motor or an operation to cause any of the actuators in a working machine to be driven brings the braking apparatus into a braking release state and thus makes its operation simplified.

The present invention further provides in a third form of embodiment thereof a braking apparatus for a hydraulic motor which includes a drain circuit for establishing a fluid communication of the said piston chamber with an internal drain path of the hydraulic motor.

BRIEF DESCRIPTION OF THF DRAWINGS

The present invention will better be understood from the following detailed description and the drawings attached hereto showing certain illustrative embodiments of the present invention. In this connection, it should be noted that such embodiments as illustrated in the accompanying drawings are intended in no way to limit the present invention but to facilitate an explanation and understanding thereof.

BEST MODES FOR CARRYING OUT THE INVENTION

Hereinafter, suitable embodiments of the present invention with regard to a braking apparatus for a hydraulic motor are set forth with reference to the accompanying drawings hereof.

Figure 1:
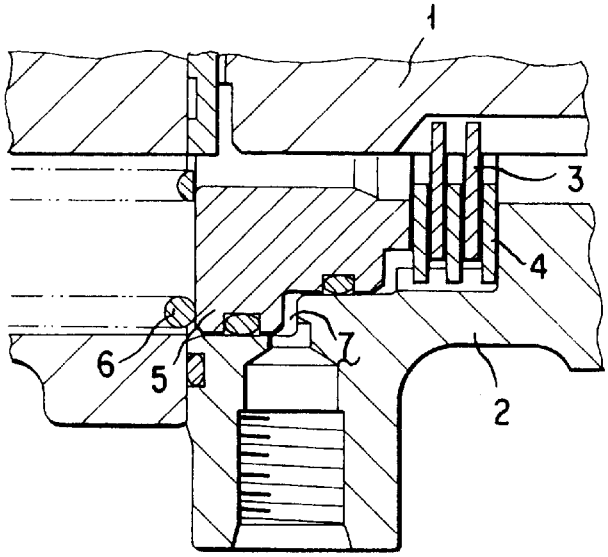
FIG. 1 is a cross sectional view that shows a conventional braking apparatus for a hydraulic motor.
Figure 2:
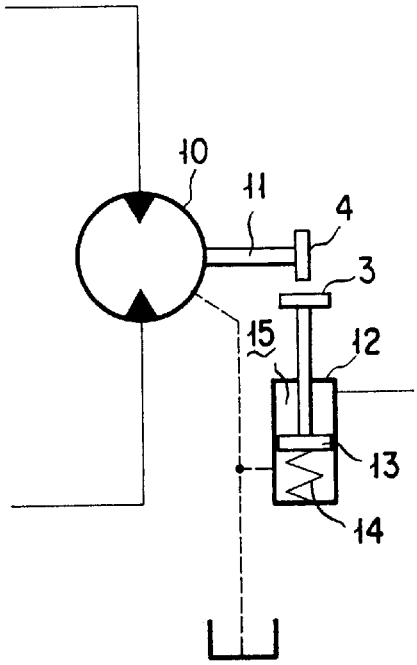
FIG. 2 is a schematic diagram of the conventional for a hydraulic motor.
Figure 3:
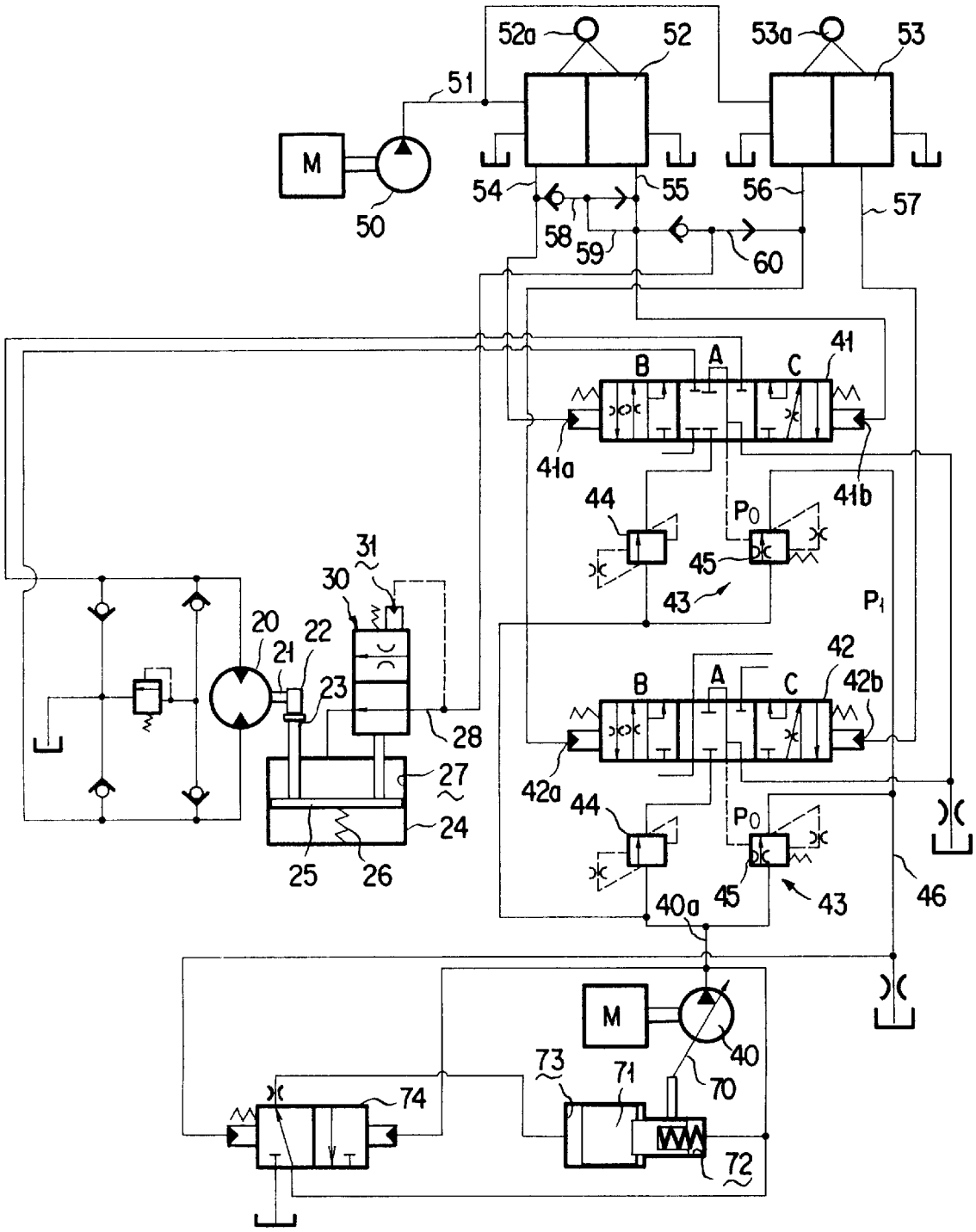
FIG. 3 is a schematic diagram that shows a first embodiment of a braking apparatus for a hydraulic motor provided in accordance with the present invention.

As shown in FIG. 3, a hydraulic motor 20 that is adapted for use in turning an object includes a rotary portion 21 that has a rotation side friction plate 22 attached thereto. A fixed side friction plate 23 that is attached to a fixed side of the hydraulic motor is adapted for displacement by a braking cylinder assembly 24. The braking cylinder assembly 24 has a piston 25 that is adapted to be mechanically energized by a spring 26 in a direction in which it is extended to apply a braking action (in a braking direction) and to be displaceable in a piston pressure receiving chamber 27 in a direction in which it is retracted (in a braking release direction).

Connected to the piston pressure receiving chamber 27 is a hydraulic circuit 28 that is provided with a fluid flow control means 30. The fluid flow control means 30 is adapted to be pushed by pressure fluid in the pressure receiving chamber 31 in a direction in which its area of opening is reduced and to be pushed in a direction in which the area of opening is increased by displacement of the piston 25 from its breaking release position towards its braking position. The flow control means 30 has a pressure receiving portion 31 connected to an upstream side of the hydraulic circuit 28.

A hydraulic motor, designated by reference numeral 40, is adapted to be driven by an engine M and has a fluid discharge path 40*a* provided with a turning action dedicated operating valve 41, a plurality of working machine action dedicated operating valves including, for example an arm action dedicated operating valve 42 as well as a boom action dedicated operating valve and a bucket action operating valve (not shown), all of these operating valves being connected parallel to one another. Connected at the inlet side of each these valves 41 and 42 and those not shown is a pressure compensation valve 43 which having a check valve portion 44 and a pressure reducing valve portion 45 may be of any of the constructions well known in the art. The valve 43 is designed to perform a pressure compensation function under a load pressure P0 for its own associated actuator and a load pressure P1 detected at a load pressure sensing circuit 46. It should be noted that the load pressure sensing circuit 46 has a load pressure introduced therein that becomes the highest when a plurality of hydraulic actuators with which the above mentioned operating valves may be associated are to be operated simultaneously.

A hydraulic pump 50, which is provided to supply pilot pressure fluid, is designed to be also driven by the above mentioned engine M and has, as shown, connected at its fluid discharge path 51 a hydraulic pilot valve 52 dedicated to an turning operation, an arm operation dedicated hydraulic pilot valve 53. The turning operation dedicated hydraulic pilot valve 52 has a first and a second output circuit 54 and 55 connected to the turning action dedicated operating valve 41 at a first and a second pressure receiving portion 41*a* and 41*b* thereof, respectively. The arm operation dedicated hydraulic pilot valve 53 has a third and a fourth output circuit 56 and 57 connected to the arm action dedicated operating valve 42 at a first and a second pressure receiving portion 42*a* and 42*b*, respectively.

A first sensing circuit 59 is connected via a first shuttle valve 58 to the first and second output circuits 54 and 55 to detect high pressure fluid (pilot pressure fluid) at the latter two. The hydraulic circuit 28 mentioned previously is connected via a second shuttle valve 60 to the first sensing circuit 59 and the third output circuit 56 to detect high pressure fluid at the latter two.

The hydraulic pilot valve 52, 53 is adapted, with a lever 52*a*, 53*a* operated in one direction, to furnish pilot pressure fluid to the first, third output circuit 54, 56 and with the same lever operated in the opposite direction, to furnish pilot pressure fluid to the second, fourth output circuit 55, 57.

Operating the lever 52*a* for the turning operation dedicated hydraulic pilot valve 52 in the one or the other direction to furnish pilot pressure fluid to the first or second output circuit 54 or 55 switches the turning action dedicated operating valve 41 from its neutral position A to its first position B or its second position C while operating the lever 53*a* for the arm operation dedicated hydraulic pilot valve 53 in the one direction to furnish pilot pressure fluid to the third output circuit 56 switches the arm action dedicated operating valve 42 to its second position B. Switching the turning action dedicated operating valve 41 from to its first position B or its second position C while switching the arm action dedicated operating valve 42 to its second position B furnishes pilot pressure fluid to the hydraulic circuit 28, thereby supplying pressure fluid into the piston pressure receiving chamber 27 to release the braking apparatus from its braking state.

An explanation will now be given in detail of an operation of the braking apparatus described.

In the state shown in FIG. 3, the piston 25 in the braking cylinder assembly 24 is pushed by the spring 26 in the braking direction to urge the fixed side friction plate 23 into pressure contact with the rotation side friction plate 22 to hold the braking apparatus in braking state. The flow control means 30 has then its area of opening enlarged.

When pressure fluid flows into the hydraulic circuit 28, a plenty of the pressure fluid supplied past the flow control valve 30 into the piston pressure receiving chamber 27 causes rapid displacement of the piston 25 against the spring 26 in the braking release direction to separate the fixed side friction plate 23 away from the rotation side friction plate 22 to release the braking apparatus from its braking state.

At the same time, the flow control valve 30 with pressure fluid from the hydraulic circuit 28 acting on its pressure receiving portion 31 is pushed towards a direction in which its area of opening is reduced, reducing fluid flow into the piston pressure receiving chamber 27 decelerating displacement of the piston 25 in the braking release direction.

More specifically, displacement of the piston 25 until it reaches its stroke end while progressively reducing the area of opening of the flow control valve 30 (in two steps) progressively reduces fluid flow supplied into the piston pressure receiving chamber 27, progressively decelerating displacement of the piston 25 in the braking release direction.

It can be seen therefore that the fluid flow of pressure fluid supplied into the piston pressure receiving chamber 27 of the braking cylinder assembly 24 is great in an initial stage of the time period in which braking is released and is thereafter progressively reduced. Since the fluid flow supplied into the first output circuit 54, the second output circuit 55 and the third output circuit is thus not much reduced and as a consequence the pressure drop in the fluid discharge path 51 is reduced, where a compound operation for both a turning dedicated hydraulic motor and an arm action dedicated cylinder assembly is to be effected by simultaneously switching the turning action dedicated operating valve 41 and the arm action dedicated operating valve 42, these operating valves can be switched smoothly.

In this manner, releasing the braking apparatus from its braking state by using a pilot pressure fluid furnished from a hydraulic pilot valve, 52 dedicated to a turning action, 53 dedicated to an arm action allows the braking apparatus to be automatically released from its braking state when the hydraulic motor 20 dedicated to the turning action is being rotated and the arm action dedicated cylinder assembly (not shown) is being operated, and allows the braking apparatus to be automatically locked into its braking state when the turning action dedicated hydraulic motor 20 is not being operated and the arm action dedicated cylinder assembly is not being operated. Hence, any separate switching valve or controller for performing a braking action and a braking release action is made unnecessary.

It should be noted that it is for the purpose of hydraulically holding the upper vehicle body in an offset excavating operation of the hydraulic power shovel that the braking apparatus is released from its braking state when the arm action dedicated cylinder assembly is being operated.

More specifically, in a hydraulic power shovel in which an upper vehicle body is mounted on a lower vehicle body so as to be turnable by a turning action dedicated hydraulic motor and the upper vehicle body has mounted on it a boom, an arm and a bucket that constitute an excavator so as to be vertically rotatable by their respective working cylinder assemblies, the upper vehicle body tends to be placed under an excessive rotary torque when an excavating operation is being carried out. As a consequence, the problem is brought about that the hydraulic motor (including a reducer) may be damaged and a noise may be emitted if a braking apparatus is held in its braking state. It is thus necessary then for the braking apparatus to be off its braking state to maintain the upper vehicle body to be hydraulically turnable.

In FIG. 3, it should also be noted that the hydraulic pump 40 is designed to be a variable displacement pump with its displacement controllably increased and decreased by changing the angle of inclination of a swash plate 70 with a control piston 71. The control piston 71 is slidably displaced under a self-discharge pressure (i.e. a discharge pressure of the hydraulic motor 40) of fluid supplied into a small pressure receiving chamber 72 and a large pressure receiving chamber 73 in the directions in which a pump displacement is increased and decreased. The self-discharge pressure fluid is supplied into the large pressure receiving chamber 73 via the control valve 74 which is switching operated under both a load pressure and the self-discharge pressure so that the displacement of the hydraulic pump 40 may be controlled so as to maintain the balance between the self-discharge pressure and the load pressure (P0–P1) substantially constant.

More specifically, the above mentioned operating valves 41 and 42 are designed to be each of closed center type in which when it is in its neutral position A its inlet port is closed. The operating valve 41, 42 is brought into its neutral position A to make the load pressure zero, thus minimizing the displacement of the hydraulic motor 40 to reduce the self-discharge pressure and in turn to diminish the driving horse power of the engine M. When the operating valve is switched to assume its first position B or second position C, a consequential rise in the load pressure causes the displacement of the hydraulic motor 40 to be increased and in turn its self-discharge pressure to be elevated. Thus, the balance between the self-discharge pressure and the load pressure are so maintained constant.

An explanation will now be given of a specific structure of the fluid flow control means.

Figure 4:
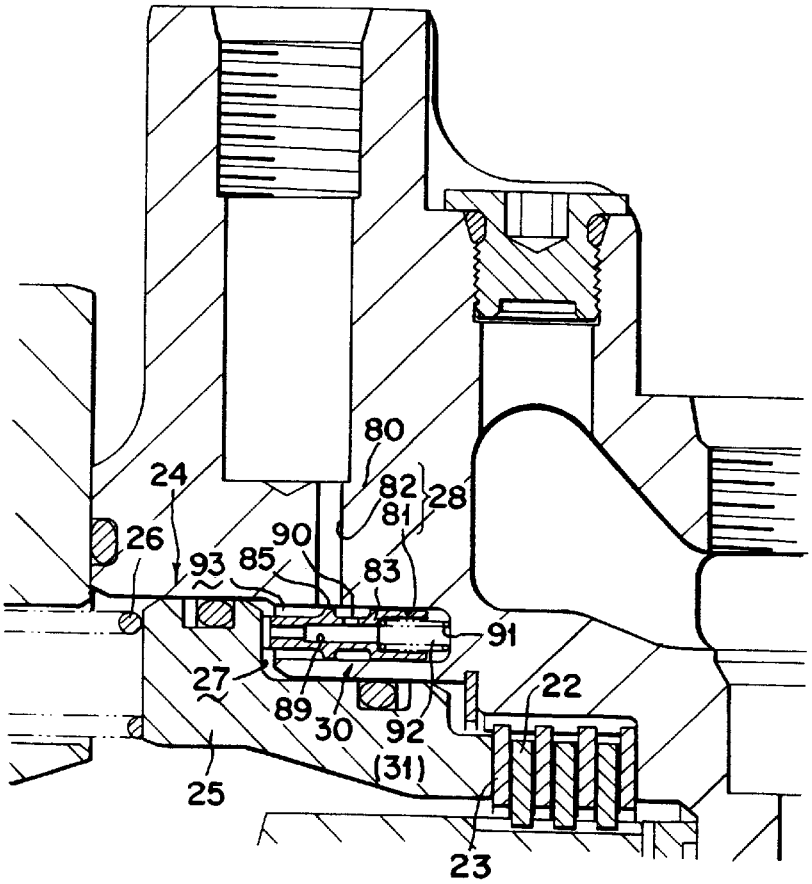
FIG. 4 is a cross sectional view that shows a specific structure of a flow control means that is included in the said first embodiment of the present invention.
Figure 5:
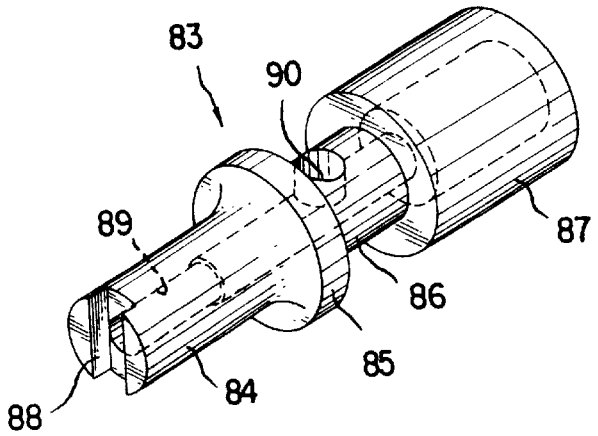
FIG. 5 is a perspective view that shows a spool that is included in the said flow control means.

As shown in FIG. 4, a housing 80 has formed in it a bore 81 that is in fluid communication with the piston pressure receiving chamber 27, and a fluid bore 82 that is in fluid communication with the bore 81, providing the hydraulic circuit 28 shown in FIG. 3. The bore 81 has a spool 83 slidably inserted therein, which as shown in FIG. 5 is formed with a small diameter end portion 84, an intermediate land portion 85, an annular groove 86 and a large diameter base portion 87. On the front end face of the spool 83 a slit 88 is formed diametrically and is formed on a bottom thereof with an axial bore 89 that is in fluid communication via a port 90 with the annular groove portion 86 and also in fluid communication with the rear end face of the spool 83.

The spool 83 is pushed by a spring 91 against the piston 25, and the piston pressure receiving chamber 27 is in fluid communication with a spring chamber 92 (corresponding to the pressure receiving portion 31) via the axial bore 89.

When the piston 25 is placed in a braking portion, as shown in FIG. 4 the fluid bore 82 is held in fluid communication with the piston pressure receiving chamber 27 via an annular space 93 formed between the small diameter end portion 84 and the bore 81, the port 90 and the axial bore 89. Then, the fluid bore 82 and the piston pressure receiving chamber 24 have an enlarged area of opening or fluid communication between them.

Displacement of the piston 25 in the braking release direction (leftwards as shown in FIG. 4) causes the intermediate land 85 to reduce an area of opening between the fluid bore 82 and the annular space 93 and thereby the area of opening or fluid communication between the fluid bore 82 and the piston pressure receiving chamber 27 to be reduced.

Figure 6:
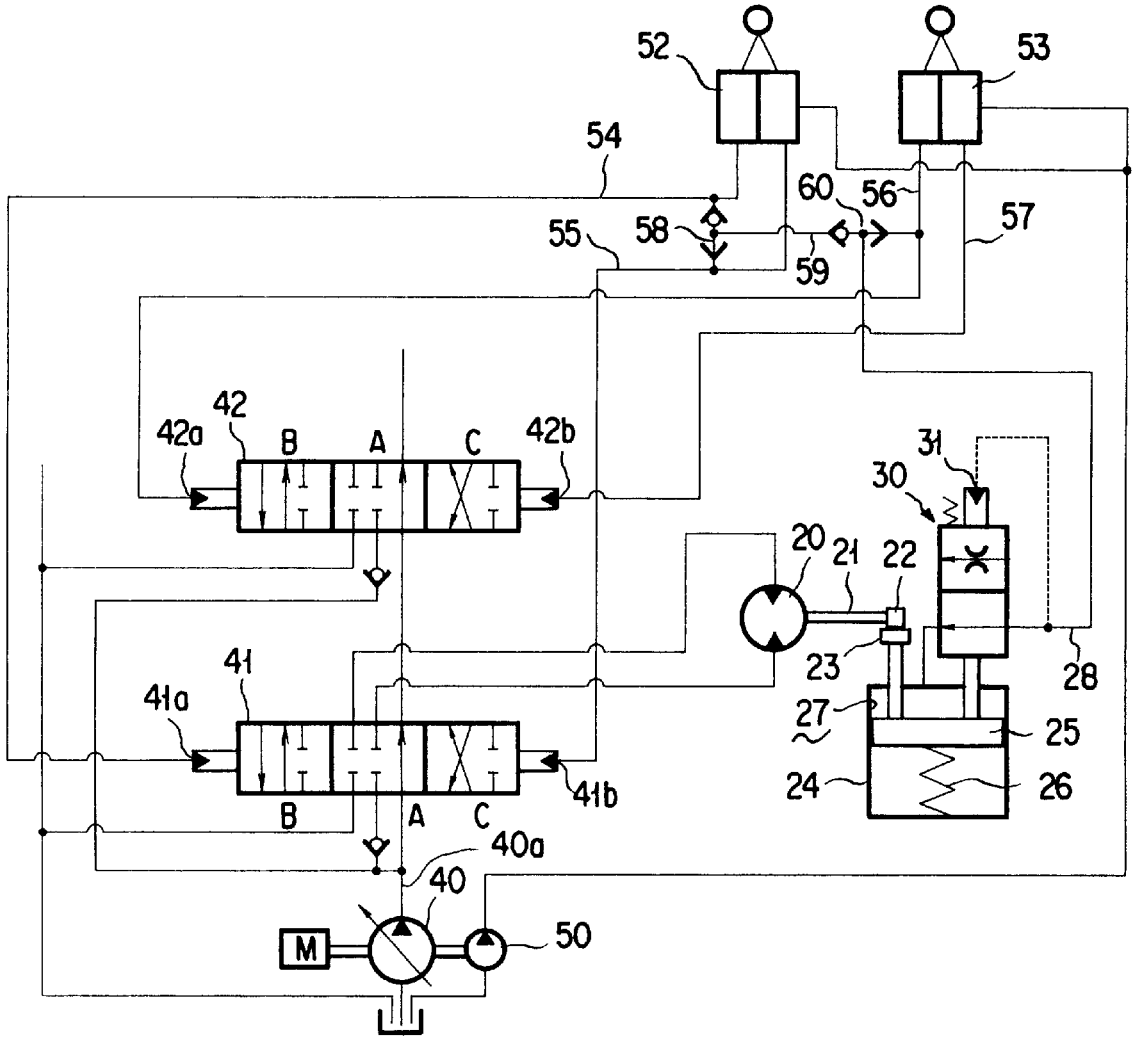
FIG. 6 is a schematic diagram that shows a second embodiment of a braking apparatus according to the present invention.

FIG. 6 shows a second embodiment of the present invention having the turning action dedicated operating valve 41 and the arm action dedicated operating valve 42 each constituted to be of open center type in which when the valve is held in its neutral position its inlet port is in fluid communication with a reservoir.

Figure 7:
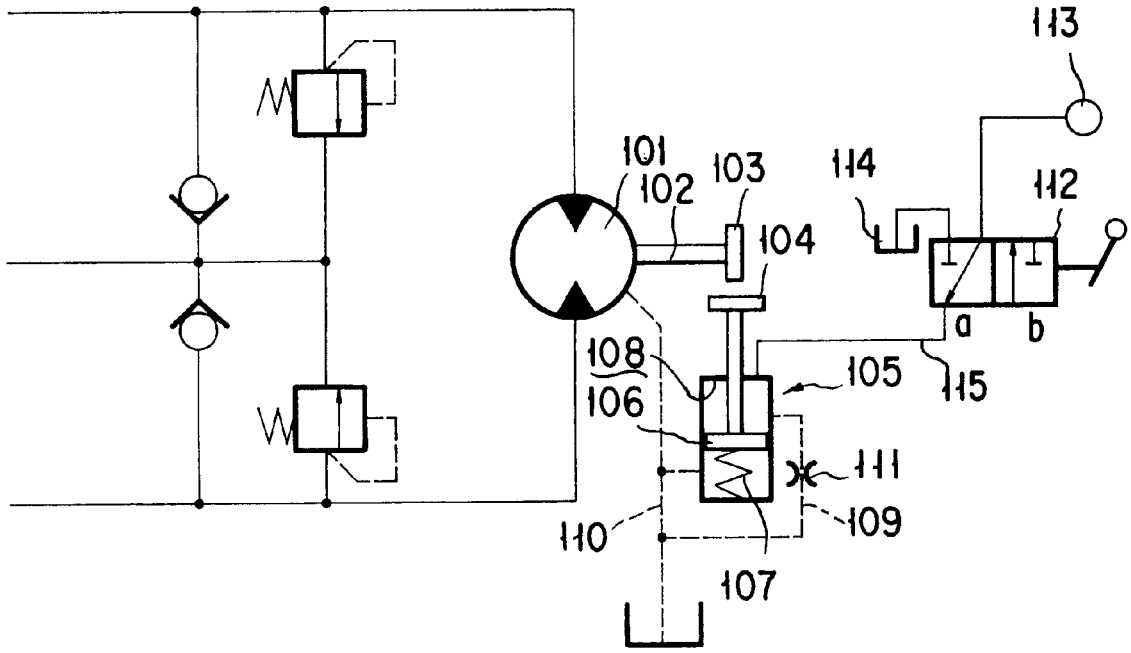
FIG. 7 is a schematic diagram that shows a third embodiment of a braking apparatus according to the present invention.

An explanation will now be given with respect to a third embodiment of the present invention As shown in FIG. 7, a turning action dedicated hydraulic motor 101 has a rotary portion 102 that has a friction plate (rotation side friction plate) 103 secured to it. Another friction plate (fixed side friction plate) 104 and a braking cylinder assembly 105 are secured to a fixed portion of the hydraulic motor 101 such as a housing of it. A piston 106 in the braking cylinder assembly 105 is adapted to be movable in a braking direction to urge the fixed side friction plate 104 into a pressure contact with the rotation side friction plate 103. The piston 106 is also displaceable under fluid pressure in a piston pressure receiving chamber 108 in a braking release direction such as to separate the fixed side friction plate 104 away from the rotation side friction plate 103.

Connected to the piston pressure receiving chamber 108 is a drain circuit 109 which is in turn connected to an internal drain path 110 of the hydraulic motor 101. The drain circuit 109 has a restriction 111 provided therein.

The piston pressure receiving chamber 108 is adapted to be connected by a switching valve 112 alternately with a fluid pressure source 113 and a reservoir 114.

An explanation will now be given of an operation of this third embodiment.

Placing the switching valve 112 in its first position a as shown in FIG. 7 to cause pressure fluid to flow from the switching valve 112 and to be supplied past a hydraulic path 115 into the piston pressure receiving chamber 108 releases the braking apparatus from its braking state. Then, permitting air that remains in the path 115 to be expelled through the drain circuit 109 into the internal drain path 110 of the hydraulic motor 101 allows the time expended after a braking action is initiated until it is completed to be shortened. If from this state the switching valve 112 is switched to its second position b, the pressure fluid in the piston pressure receiving chamber 108 is allowed to flow out into the reservoir 114 and at the same time to flow out through the drain circuit 109 into the internal drain path 110 of the hydraulic motor 101. Then, even if a pressure remains in the hydraulic path 115, the spring 107 urges the fixed side friction plate 104 into a firm pressure contact with the rotation side friction plate 103, permitting a braking torque that is commensurate with the spring force to ensue.

Figure 8:
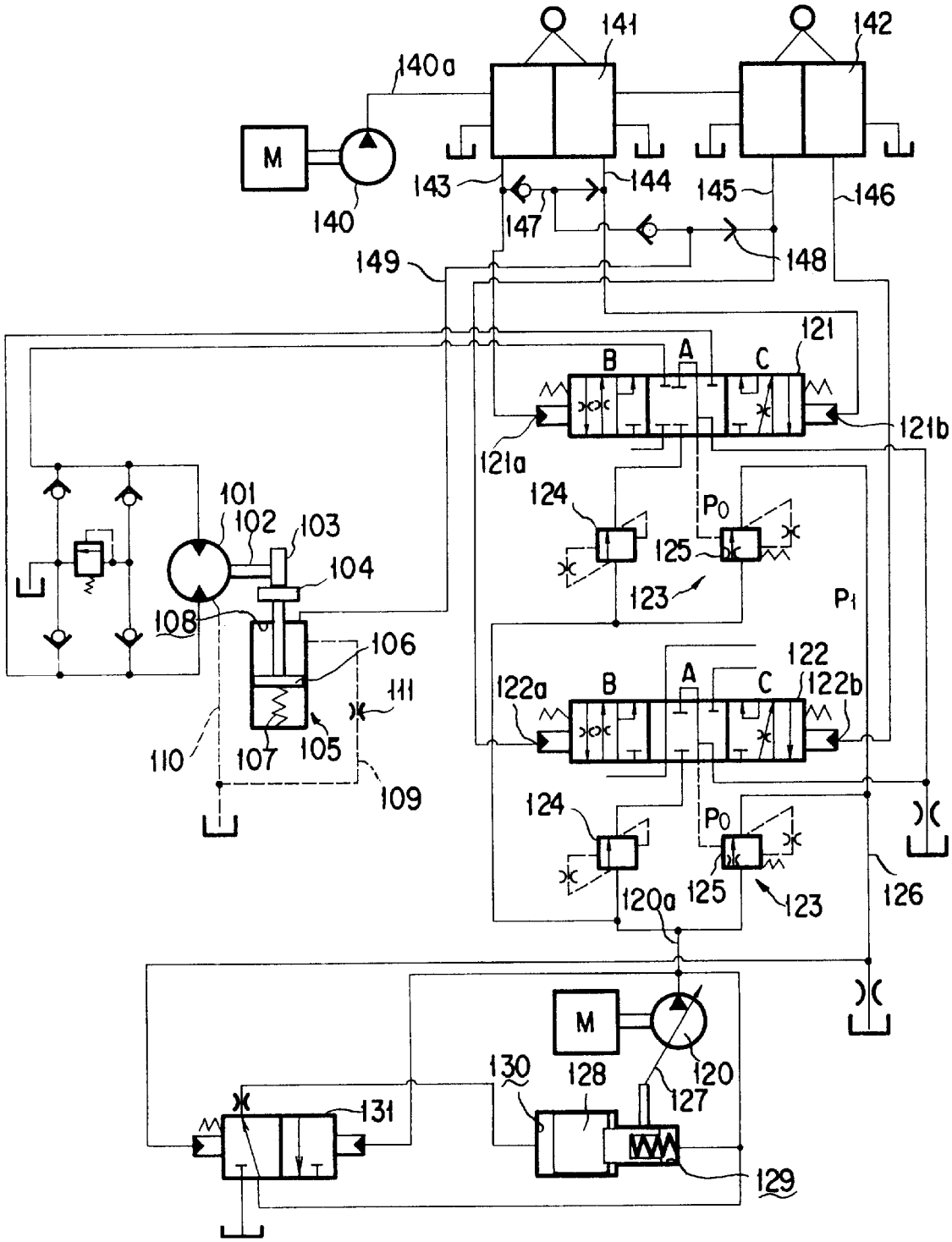
FIG. 8 is a schematic diagram that shows a fourth embodiment of a braking apparatus according to the present invention.

FIG. 8 shows a fourth embodiment of the present invention in which a hydraulic pump 120 adapted to be driven by an engine M has in a discharge path 120*a* thereof a turning action dedicated operating valve 121 and a working machine action dedicated operating valve 122 connected in parallel so that pressure fluid may be supplied into the turning action dedicated hydraulic motor 101 as well as into a working machine action dedicated actuator such as a working machine action dedicated cylinder assembly not shown. Each of these operating valves has at its inlet side a pressure compensation valve 123 which may be of any type well known in the art, having a check valve portion 124 and a pressure reducing valve portion 125 to effect a pressure compensation according to a load pressure P0 of its associated hydraulic actuator and a load pressure P1 from a load pressure sensing circuit 126. It should be noted that the load pressure sensing circuit 126 has introduced in it a load pressure that becomes highest when a plurality of the actuators are simultaneously operated.

The hydraulic pump 120 is designed to be a variable displacement pump with its displacement controllably increased and decreased by changing the angle of inclination of a swash plate 120 with a control piston 128. The control piston 128 is slidably displaced under a self-discharge pressure (i.e. a discharge pressure of the hydraulic motor 120) of fluid supplied into a small pressure receiving chamber 129 and a large pressure receiving chamber 130 in the directions in which pump displacements are increased and decreased. The self-discharge pressure fluid is supplied into the large pressure receiving chamber 130 by the control valve 131 which is switching operated under both a load pressure and the self-discharge pressure so that the displacement of the hydraulic pump 120 may be controlled so as to maintain the balance between the self-discharge pressure and the load pressure substantially constant.

Thus, providing a hydraulic pump 120 with its displacement controllable in this fashion and providing pressure compensation valves 123 allows discharge pressure fluid of a single hydraulic pump 120 to be supplied into a plurality of hydraulic actuators with a plurality of the operating valves operated simultaneously and at a ratio of fluid flows divided in proportion to the areas of opening of these operating valves.

A hydraulic pump 140, which is provided to supply pilot pressure fluid, is designed to be driven by the engine M and has, as shown, connected at its fluid discharge path 140*a* a hydraulic pilot valve 141 dedicated to an turning operation, a working operation dedicated hydraulic pilot valve 142. The turning operation dedicated hydraulic pilot valve 141 has a first and a second output circuit 143 and 144 connected to the turning operation dedicated operating valve 121 at a first and a second pressure receiving portion 121*a* and 121*b* thereof, respectively. The working operation dedicated hydraulic pilot valve 142 has a third and a fourth output circuit 145 and 146 connected to the working operation dedicated operating valve 122 at a first and a second pressure receiving portion 122*a* and 122*b*, respectively.

The first output circuit 143 and the second output circuit 144 are connected to the inlet side of a first shuttle valve 147. The outlet side of the shuttle valve 147 and the third output circuit 145 are connected to the inlet side of a second shuttle valve 148 whose outlet side is connected via a hydraulic circuit 149 to the piston pressure receiving chamber 108 of the braking cylinder assembly 105.

An explanation will now be given of an operation of this fourth embodiment.

The turning operation dedicated hydraulic pilot valve 141 is operated to furnish pilot pressure fluid to the first output circuit 143 or the second output circuit 144, thereby switching the turning action operating valve 121 to its first position B or second position C to rotate the hydraulic motor 101 normally or reversely.

At the same time, the pilot pressure fluid furnished from the turning operation dedicated hydraulic pilot valve 141 flows through the hydraulic circuit 149 and is supplied into the piston pressure receiving chamber 108 in the braking cylinder assembly 105 to release the braking apparatus from its braking state. Then, air that remains in the hydraulic circuit 149 is expelled in a manner as mentioned previously.

In the state being established mentioned above, it should be noted that a portion of pressure fluid flowing out of the piston pressure receiving chamber 108 in the braking cylinder assembly 105 does not cause a pressure drop in the piston pressure receiving chamber 108 by virtue of the restriction 111 provided in the drain circuit 109.

Switching the turning operation dedicated pilot hydraulic valve 141 to its neutral position in a state in which the hydraulic motor 101 is rotating and the braking apparatus is released from its braking state causes the pilot fluid to be no longer furnished, thus switching the turning action dedicated operating valve 121 to its neutral state A to terminate the rotation of the hydraulic motor 101.

This, causing the piston pressure receiving chamber 108 of the braking cylinder assembly 105 to be no longer supplied with pressure fluid while permitting pressure fluid to flow out of the piston pressure receiving chamber 108 to flow through the drain circuit 109 into the internal drain path 110 of the hydraulic motor 101 ensures that the braking apparatus is brought into a braking state even if pressure fluid flow through the hydraulic circuit 149 does not flow through the second shuttle valve 148 into the reservoir. It should be noted here that in the instance of operating the working operation dedicated hydraulic pilot valve 142 to furnish the third output circuit 145 with pilot pressure fluid, thereby switching the working action dedicated operating valve 122 to actuate the working dedicated cylinder assembly, the braking apparatus is actuated in a same manner as mentioned previously.

Figure 9:
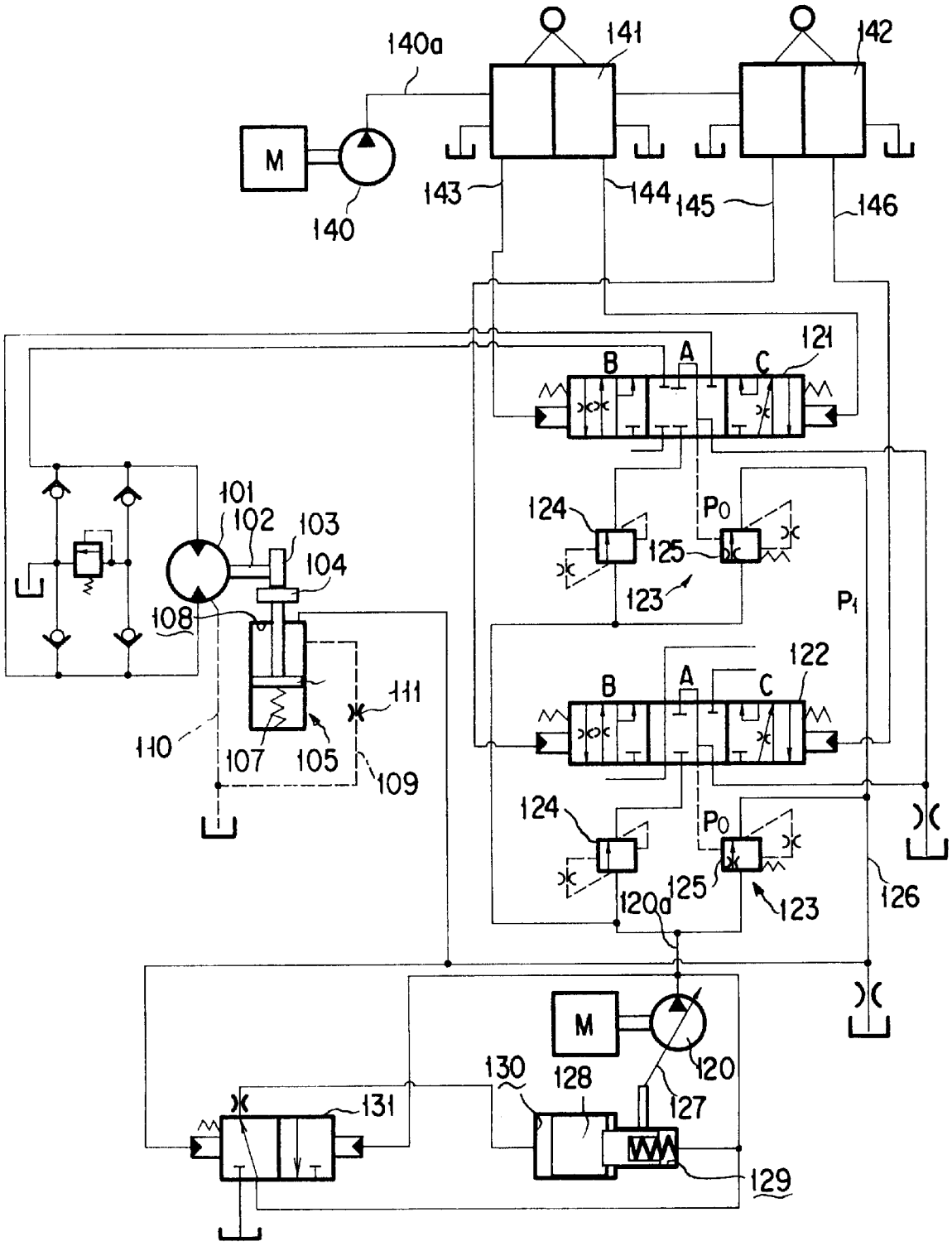
FIG. 9 is schematic diagram that shows a fifth embodiment of a braking apparatus according to the present invention.

FIG. 9 shows a fifth embodiment of the present invention in which a piston pressure receiving chamber 108 of a braking cylinder assembly 105 is connected to a load pressure sensing circuit 126.

This embodiment thus allows the braking apparatus to be brought into a braking release state with a load pressure in the turning action dedicated hydraulic motor 101 or with a load pressure in a working action dedicated cylinder assembly.

Figure 10:
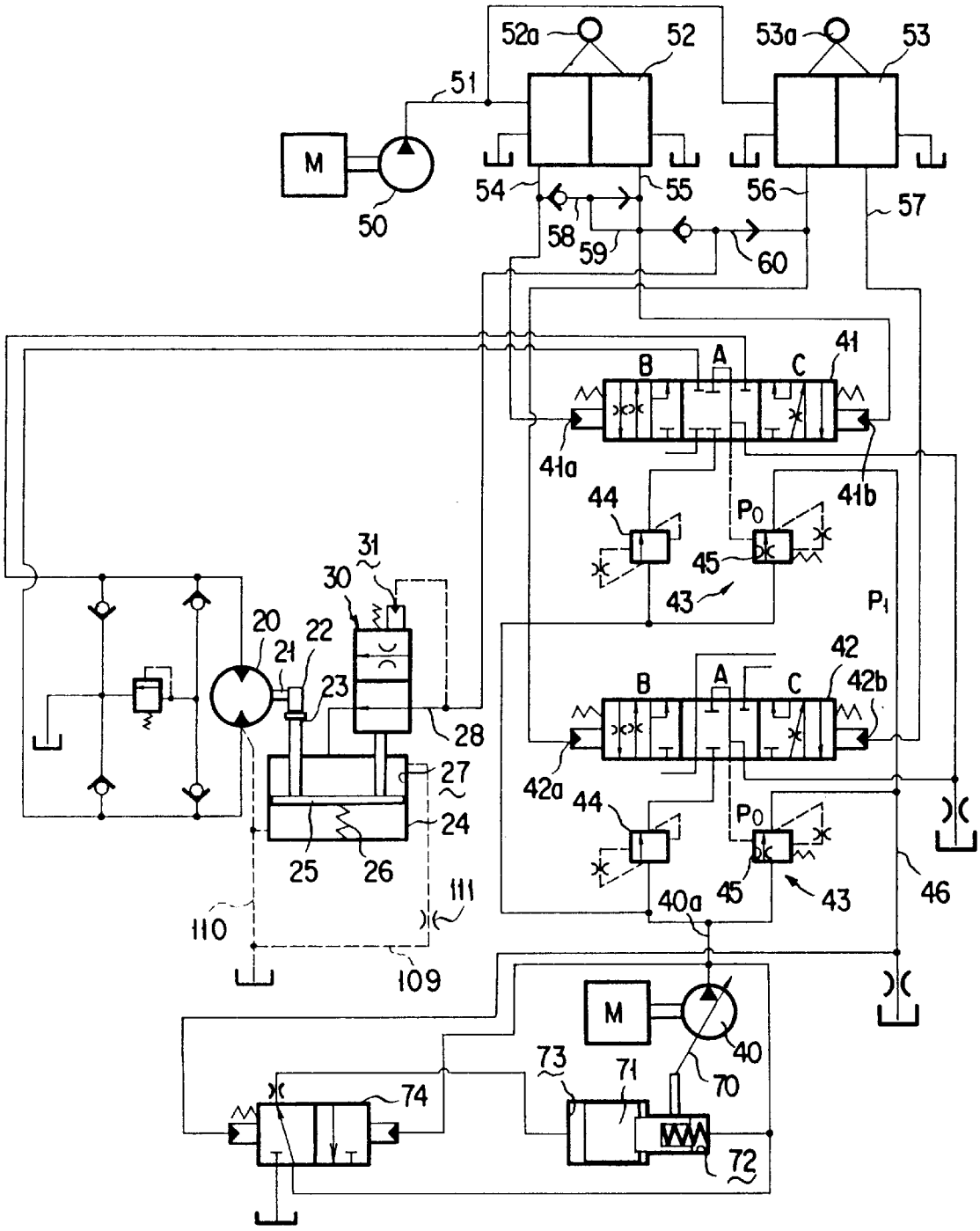
FIG. 10 is a schematic diagram that shows a sixth embodiment of a braking apparatus according to the present invention.

FIG. 10 shows a fifth embodiment of the present invention, which is designed to add an air extracting arrangement as included in the aforementioned third embodiment to the first embodiment previously described.

Figure 11:
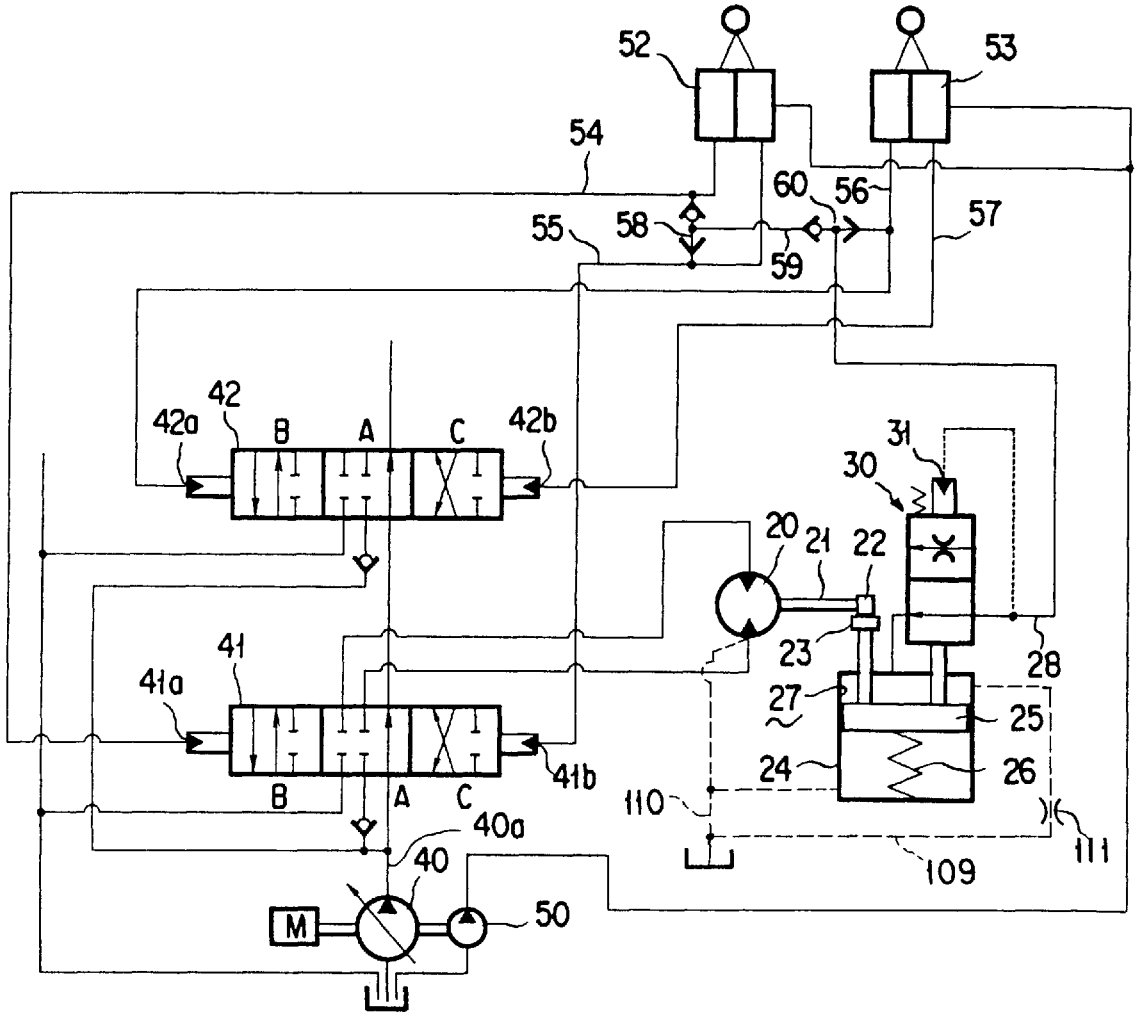
FIG. 11 is a schematic diagram that shows a seventh embodiment of a braking apparatus according to the present invention.

FIG. 11 shows a seventh embodiment of the present invention, that is designed to add an air extracting arrangement as included in the aforementioned third embodiment to the second embodiment previously described.

An explanation will finally be given of a specific structure of a restriction 111 as previously mentioned.

Figure 12:
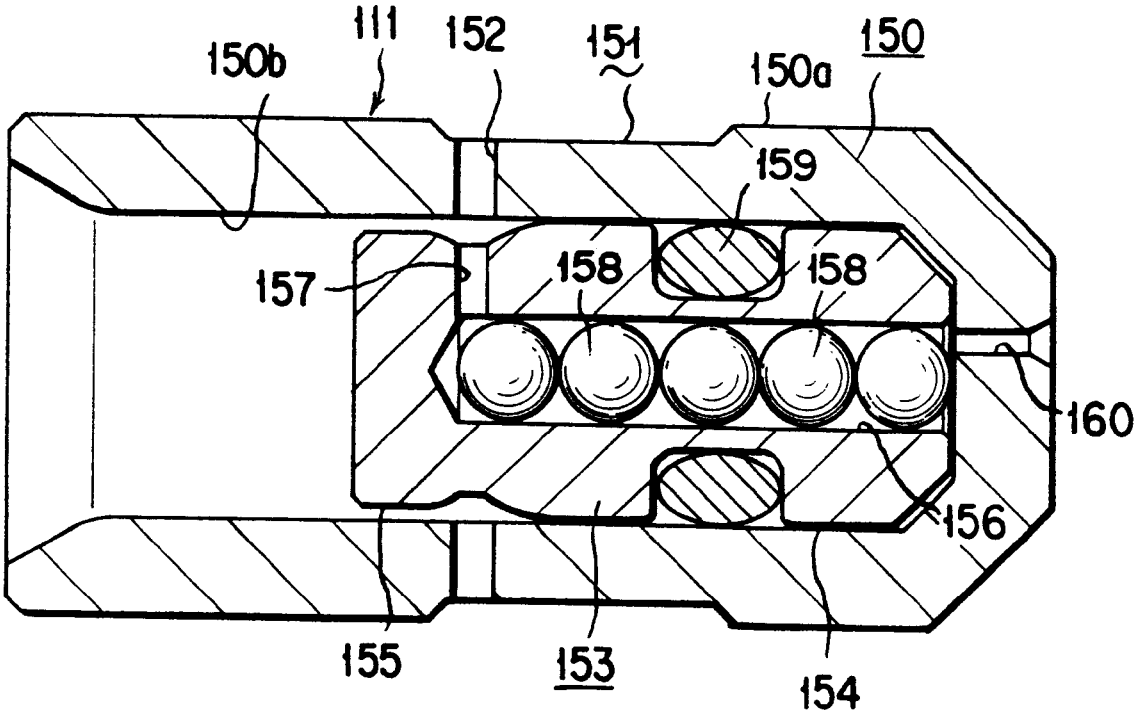
FIG. 12 is a cross sectional view that shows a specific structure of a restriction that may be included in the said third through seventh embodiments of the invention.

As shown in FIG. 12, a sleeve 150 has an outer peripheral surface 150*a* formed with an annular recess 151 that communicates via bore 152 with an inner peripheral surface 150*b* of the sleeve 150. A piston 153, which is slidably fitted in the sleeve 150, is of a stepped shape having a large diameter portion 154 and a small diameter portion 155 and is axially formed with a bore 156. A portion of the bore 156 that is closer to its bottom is formed to communicate via a small bore 157 with the small diameter portion 155, and a plurality of balls 158 which are smaller in diameter than the inner diameter of the bore 156 are slidably fitted in the bore 156 of the piston 153.

A space between the large diameter portion 154 of the piston 153 and the inner peripheral surface 150*b* of the sleeve 150 is sealed with a sealing material 159, and the small bore 157 is formed to communicate with a small bore 160 of the sleeve 150 so that pressure fluid introduced through the bore 152 may flow through the small bore 157 and an interstice which are formed by the wall of the small bore 157 and the balls 158 and flows out of the small bore 160.

The interstice between the wall of the bore 156 and the balls 158 which is essentially defined by a difference in diameter between the bore 156 and the balls 158, thus provides a restriction that is compact and highly effective to restrict a flow of pressure fluid when passing through the interstice.

The interstice that is formed between the wall of the bore 156 and the balls 158 being annular, it can be seen that a block of one portion of the interstice with a foreign matter permits pressure fluid to flow through another portion of the interstice.

While the present invention has hereinbefore been set forth with respect to certain illustrative embodiments thereof, it will readily be appreciated by a person skilled in the art to be obvious that many alterations thereof, omissions therefrom and additions thereto can be made without departing from the essence and the scope of the present invention. Accordingly, it should be understood that the present invention is not intended to be limited to the specific embodiments thereof set out above, but to include all possible embodiments thereof that can be made within the scope with respect to the features specifically set forth in the appended claims and encompasses all the equivalents thereof.

What is claimed is:

1. A braking apparatus for a hydraulic motor, comprising:

a rotary side friction plate coupled to a rotary component of the hydraulic motor;

a fixed side friction plate coupled to a fixed component of the hydraulic motor;

a braking cylinder assembly having a piston, a piston pressure receiving chamber and a spring, wherein said piston is adapted to be energized by said spring to move in a braking direction for bringing said fixed side friction plate and said rotary side friction plate into a pressure contact, and said piston pressure receiving chamber is adapted to be supplied with pressure fluid to displace said piston in a braking release direction too separate said fixed side friction plate and said rotary side friction plate from each other;

an operating valve for supplying pressure fluid into said hydraulic motor;

a hydraulic pilot valve for providing pilot pressure fluid for use to switch said operating valve;

a hydraulic circuit for delivering pilot pressure fluid from said hydraulic pilot valve into said piston pressure receiving chamber; and a fluid flow control valve in said hydraulic circuit and having an area of valve opening progressively reduced as a function of a distance of travel of said piston moving and displaced from a braking position towards a braking release position.

2. A braking apparatus for a hydraulic motor, as set forth in claim 1 in which said flow control valve includes:

a fluid control bore disposed in a housing of said hydraulic motor and being in fluid communication with said piston pressure receiving chamber;

a fluid inlet bore being in communication with said fluid control bore through an area of fluid communication and adapted to accept the pilot pressure fluid from said hydraulic pilot valve;

a spool slidably fitted in said fluid control bore;

a spring chamber defined at one end side of said spool;

a spring accommodated in said spring chamber for urging said spool in contact with said piston; and an axial bore formed in said spool for normally maintaining said piston pressure receiving chamber and said fluid inlet bore in communication with said spring chamber, wherein said spool is shaped so as to allow the area of fluid communication between said fluid inlet bore and said piston pressure receiving chamber to be progressively reduced as a function of a distance of travel of said spool displaced towards said piston.

3. A braking apparatus for a hydraulic motor, as set forth in claim 1, in which said pressure fluid supply means is constituted by a separate source of pressure.

4. A braking apparatus for a hydraulic motor, as set forth in claim 1, in which said pressure fluid supply means is constituted by a hydraulic pilot valve for providing pilot pressure fluid for use to switch an operating valve that is dedicated for supplying pressure fluid into the hydraulic motor.

5. A braking apparatus for a hydraulic motor, as set forth in claim 1, in which said pressure fluid supply means is constituted by a load pressure sensing circuit for detecting a load pressure in effect on said hydraulic motor and/or an operating machine actuator.

6. A braking apparatus for a hydraulic motor, as set forth in claim 1, further comprising a drain circuit for establishing a fluid communication of said piston chamber with an internal drain path of said hydraulic motor.

7. A braking apparatus for a hydraulic motor, as set forth in claim 2, in which said pressure fluid supply means is constituted by a separate source of pressure.

8. A braking apparatus for a hydraulic motor, as set forth in claim 2, in which said pressure fluid supply means is constituted by a hydraulic pilot valve for providing pilot pressure fluid for use to switch an operating valve that is dedicated for supplying pressure fluid into the hydraulic motor.

9. A braking apparatus for a hydraulic motor, as set forth in claim 2, in which said pressure fluid supply means is constituted by a load pressure sensing circuit for detecting a load pressure in effect on said hydraulic motor and/or an operating machine actuator.

10. A braking apparatus for a hydraulic motor, comprising:

a rotary side friction plate coupled to a rotary component of the hydraulic motor;

a fixed side friction plate coupled to a fixed component of the hydraulic motor;

a braking cylinder assembly having a piston, a piston pressure receiving chamber and a spring, wherein said piston is adapted to be energized by said spring to move in a braking direction for bringing said fixed side friction plate and said rotary side friction plate into a pressure contact, and said piston pressure receiving chamber is adapted to be supplied with pressure fluid to displace said piston in a braking release direction too separate said fixed side friction plate and said rotary side friction plate from each other;

a pressure fluid supply means for supplying and terminating a supply of, pressure fluid into said piston pressure receiving chamber;

a hydraulic circuit for delivering pressure fluid from said pressure fluid supply means to said piston pressure receiving chamber; and a drain circuit for establishing a fluid communication of said piston chamber with an internal drain path of said hydraulic motor.

11. A braking apparatus for a hydraulic motor, as set forth in claim 10, in which said pressure fluid supply means is constituted by a separate source of pressure.

12. A braking apparatus for a hydraulic motor, as set forth in claim 10, in which said pressure fluid supply means is constituted by a hydraulic pilot valve for providing pilot pressure fluid for use to switch an operating valve that is dedicated for supplying pressure fluid into the hydraulic motor.

13. A braking apparatus for a hydraulic motor, as set forth in claim 10, in which said pressure fluid supply means is constituted by a load pressure sensing circuit for detecting a load pressure in effect on said hydraulic motor and/or an operating machine actuator.

* * * * *

UNITED STATES PATENT AND TRADEMARK OFFICE

CERTIFICATE OF CORRECTION

PATENT NO. : 6,050,091
DATED : April 18, 2000
INVENTOR(S) : Kazuhiro Maruta

It is certified that error appears in the above-identified patent and that said Letters Patent is hereby corrected as shown below:

Title page,
Item [54] Title, delete "OIL".

Signed and Sealed this

Twenty fifth Day of September, 2001

*Attest:*

Nicholas P. Godici

NICHOLAS P. GODICI
*Acting Director of the United States Patent and Trademark Office*

*Attesting Officer*